US007221347B2

(12) United States Patent
Lee et al.

(10) Patent No.: US 7,221,347 B2
(45) Date of Patent: May 22, 2007

(54) APPARATUS AND METHOD TO IMPROVE A RESPONSE SPEED OF AN LCD

(75) Inventors: Sang-hak Lee, Seoul (KR); Sang-un Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 315 days.

(21) Appl. No.: 10/299,764

(22) Filed: Nov. 20, 2002

(65) Prior Publication Data

US 2003/0193460 A1 Oct. 16, 2003

(30) Foreign Application Priority Data

Apr. 10, 2002 (KR) ..... 2002-19478

(51) Int. Cl.
*G09G 3/36* (2006.01)

(52) U.S. Cl. ..... 345/89; 345/690; 324/605; 324/612; 324/613

(58) Field of Classification Search ..... 345/60, 345/63, 68, 85, 87, 89, 690; 315/169.1, 169.3; 324/605, 608, 612, 613, 614, 619
See application file for complete search history.

(56) References Cited

U.S. PATENT DOCUMENTS 3,950,705 A * 4/1976 Fuerherm ..... 327/34
5,028,874 A * 7/1991 Parle ..... 324/608
5,444,457 A 8/1995 Hotto
5,627,558 A 5/1997 Hotto
5,689,589 A * 11/1997 Gormish et al. ..... 382/239
5,831,588 A 11/1998 Hotto
5,837,947 A * 11/1998 Teterwak ..... 178/18.07
5,976,086 A * 11/1999 Matsushima ..... 600/443
6,102,864 A * 8/2000 Hatfield et al. ..... 600/454
6,104,861 A * 8/2000 Tsukagoshi ..... 386/95
6,483,249 B2 * 11/2002 Ito et al. ..... 315/169.3
6,825,824 B2 11/2004 Lee
2002/0003542 A1 * 1/2002 Tanaka et al. ..... 345/581
2002/0009097 A1 * 1/2002 Kondo et al. ..... 370/442
2002/0024481 A1 * 2/2002 Kawabe et al. ..... 345/87
2002/0089480 A1 * 7/2002 Kawasaki et al. ..... 345/87

FOREIGN PATENT DOCUMENTS

JP 2001-092415 4/2001
JP 2001-154170 6/2001

OTHER PUBLICATIONS

Korean Office Action for corresponding Korean Application No. 2002-19478 mailed Nov. 29, 2004.

* cited by examiner

*Primary Examiner*—Richard Hjerpe
*Assistant Examiner*—Vincent E. Kovalick
(74) *Attorney, Agent, or Firm*—Staas & Halsey LLP

(57) ABSTRACT

An apparatus and method thereof to improve a response speed of an LCD includes a noise rejection unit and a comparator. The noise rejection unit rejects noise in current digital image data and previous digital image data at a same pixel position as in the current digital image data. The comparator compares the current digital image data and the previous digital image data of which noises are rejected within a reference value, changes the current digital image data based on a comparison result, and outputs a result indicative thereof.

39 Claims, 5 Drawing Sheets

APPARATUS AND METHOD TO IMPROVE A RESPONSE SPEED OF AN LCD

CROSS-REFERENCE TO RELATED APPLICATIONS

This application claims the benefit of Korean Application No. 2002-19478 filed Apr. 10, 2002, in the Korean Intellectual Property Office, the disclosure of which is incorporated herein by reference.

BACKGROUND OF THE INVENTION

1. Field of the Invention

The present invention relates to an apparatus and method to operate a liquid crystal display (LCD), and more particularly, to an apparatus that rejects an error due to noise in a digital image signal to improve a response speed of an LCD, and a method therefor.

2. Description of the Related Art

As size and weight of personal computers (PCs) and televisions (TVs) reduce continuously, light and compact displays devices have been developed. As a result, flat-panel type displays such as liquid crystal displays (LCDs), have appeared and are replacing the conventional cathode ray tubes (CRTs).

The LCD is a display device that produces a desired image signal by applying an electric field to a liquid material that has anisotropic permittivity and is injected between two substrates. An amount of light transmitted to the two substrates is adjusted by controlling an intensity of the applied electric field.

Liquid crystals used in LCDs present a hold-type physical property. In other words, a state of the liquid crystals corresponding to current data is maintained until next data is input. A response speed of the liquid crystals indicates how fast the liquid crystals change according to input data. Most LCD panels have the response speed faster than 1/60 seconds, which corresponds to a speed of one frame per 16.6 ms. Accordingly, as shown in FIG. 1, a long period of time corresponding to several frames is necessary between intermediate levels of a general image until the liquid crystal reaches an appropriate voltage in response to the input data. For this reason, ghost, a reduction in a dynamic contract ratio, and blurring edges occur in moving-image display devices such as TVs, digital TVs or DVD players, thereby deteriorating image quality.

FIG. 2 is a block diagram of a conventional apparatus to improve the LCD response speed, which prevents deterioration of the image quality. Input digital image data is temporarily stored in a buffer 200 in conjunction with a frame memory 201. Current image data $D_n$ stored in the buffer 200 and previous image data $D_{n-1}$ stored in the frame memory 201 are input to a comparator 202. The comparator 202 compares a gradation of the current image data $D_n$ and a gradation of the previous image data $D_{n-1}$ at a same pixel position. If the gradation of the current image data $D_n$ and the gradation of the previous image data $D_{n-1}$ are the same, the comparator 202 outputs data $D_n'$ that has a response speed of the gradation of the current data $D_n$. If the gradation of the current image data $D_n$ is larger than the gradation of the previous image data $D_{n-1}$, the comparator 202 outputs the data $D_n'$ that has a gradation larger than that of the current data $D_n$. On the contrary, if the gradation of the current image data $D_n$ is smaller than the gradation of the previous image data $D_{n-1}$, the comparator 202 outputs the data $D_n'$ that has a gradation smaller than that of the current data $D_n$. A controller 203 controls reading or writing data from or to all blocks.

However, the use of the apparatus to improve the response speed of FIG. 2 leads the LCD to be sensitive to every kind of noise. In this case, noise on a screen, which is not serious in the LCD having slow response speed, grows worse after improving the response speed, thereby causing serious deterioration of the image quality.

SUMMARY OF THE INVENTION

Various aspects and advantages of the invention will be set forth in part in the description that follows and, in part, will be obvious from the description, or may be learned by practice of the invention.

In accordance with the above and other aspects of the present invention, there is provided an apparatus to improve a response speed of an LCD, the apparatus that rejects errors due to noise in a digital image signal to improve the response speed of the LCD.

In accordance with the above and other aspects of the present invention, there is provided a method of improving a response speed of an LCD, where errors are rejected due to noise in a digital image signal to improve the response speed of the LCD.

In accordance with the above and other aspects of the present invention, there is provided an apparatus to improve a response speed of an LCD, the apparatus including: a noise rejection unit to reject noise in current digital image data and previous digital image data at a same pixel position as in the current digital image data; and a comparator to compare the current digital image data and the previous digital image data of which noises are rejected within a reference value, to change the current digital image data based on a comparison result, and to output a result indicative thereof.

The noise rejection unit includes: a first low-pass filter (LPF) to reject a noise in the current digital image data; and a second LPF to reject the noise in the previous digital image data at the same pixel position as in the current digital image data.

The comparator includes a look up table (LUT) to hold gradation data that changes a response speed of the current digital image data.

The comparator accesses the LUT to output the current digital image data when a difference between gradations of the current digital image data and the previous digital image data, of which the noise is rejected, is smaller than the reference value.

The comparator compares the gradation of the current digital image data and the gradation of the previous digital image data, changes the current digital image data and outputs the result, when the difference between the gradations of the current digital image data and the previous digital image data of which the noise is rejected, is larger than the reference value.

The comparator accesses the LUT to increase the gradation of the current digital image data and outputs the result when the difference between the gradations of the current digital image data and the previous digital image data, of which the noise is rejected, is larger than the reference value and the gradation of the current digital image data is larger than the gradation of the previous digital image data. Also, the comparator accesses the LUT to decrease the gradation of the current digital image data and outputs the result when the difference between the gradation of the current digital image data and the previous digital image data, of which the noise is rejected, is larger than the reference value and the gradation of the current digital image data is smaller than the gradation of the previous digital image data.

In accordance with the above and other aspects of the present invention, there is provided an apparatus to improve a response speed of an LCD, including: a buffer receiving digital image data and outputting first current image data; a first noise rejection unit rejecting noise in the first current image data and outputting second current image data where noise is rejected; a frame memory storing the first current image data and outputting first previous image data, which precedes the first current image data; a second noise rejection unit outputting second previous image data indicative of noise rejected from the first previous image data; a comparator comparing gradations of the first current image data, the second current image data, the first previous image data, and the second previous image data to output the digital image data having the improved response speed.

In accordance with the above and other aspects of the present invention, there is provided a method of improving response speed of an LCD, the method including: rejecting noise in previous digital image data at a same pixel position as current digital image data; comparing a difference between gradations of the current digital image data and the previous digital image data with a reference value and outputting a result indicative thereof; and accessing an LUT storing gradation data that changes a response speed, to change the current digital image data based on the result.

When accessing the LUT, the LUT is accessed to output the current digital image data when the difference between the gradations of the current digital image data and the previous digital image data, of which the noise is rejected, in is smaller than the reference value.

When accessing the LUT, the gradation of the current digital image data is compared with the gradation of the previous digital image data, the gradation of the current digital image data is changed based on the comparison result, and the result is output when the difference between the gradations of the current digital image data and the previous digital image data, of which the noise is rejected, is larger than the reference value.

The LUT is accessed to increase the gradation of the current digital image data and output the result, when the difference between the gradations of the current digital image data and the previous digital image data, of which the noise is rejected, is larger than the reference value and the gradation of the current digital image data is larger than the gradation of the previous digital image data. Also, the LUT is accessed to decrease the gradation of the current digital image data and output the result, when the difference between the gradations of the current digital image data and the previous digital image data, of which the noise is rejected, is larger than the reference value and the gradation of the current digital image data is smaller than the gradation of the previous digital image data.

In accordance with the above and other aspects of the present invention, there is provided a method to improve a response speed of an LCD, including: outputting first current image data based on digital image data; rejecting noise in the first current image data and outputting second current image data indicative thereof; outputting first previous image data preceding the first current image data; rejecting noise in the first previous image data and outputting second previous image data indicative thereof; comparing a gradation of the second current image data and a gradation of the second previous image data; and outputting the digital image data having a same response speed as the first current image data when a difference between the gradations of the second current image data and the second previous image data is smaller than a reference value.

In accordance with the above and other aspects of the present invention, there is provided a method to improve a response speed of an LCD, including: outputting first current image data based on digital image data; rejecting noise in the first current image data and outputting second current image data indicative thereof; outputting first previous image data preceding the first current image data; rejecting noise in the first previous image data and outputting second previous image data indicative thereof; comparing a gradation of the second current image data and a gradation of the second previous image data; and determining whether the gradation of the first current image data is larger than the gradation of the first previous image data when a difference between the gradations of the second current image data and the second previous image data is larger than a reference value.

These together with other aspects and advantages which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and other aspects and advantages of the present invention will become more apparent by describing in detail preferred embodiments thereof with reference to the attached drawings in which.

DETAILED DESCRIPTION OF THE PREFERRED EMBODIMENTS

Hereinafter, embodiments of the present invention will be described in detail with reference to the attached drawings. The present invention may, however, be embodied in many different forms and should not be construed as being limited to the embodiments set forth herein; rather, these embodiments are provided so that the present disclosure will be thorough and complete, and will fully convey the concept of the invention to those skilled in the art.

Figure 1:
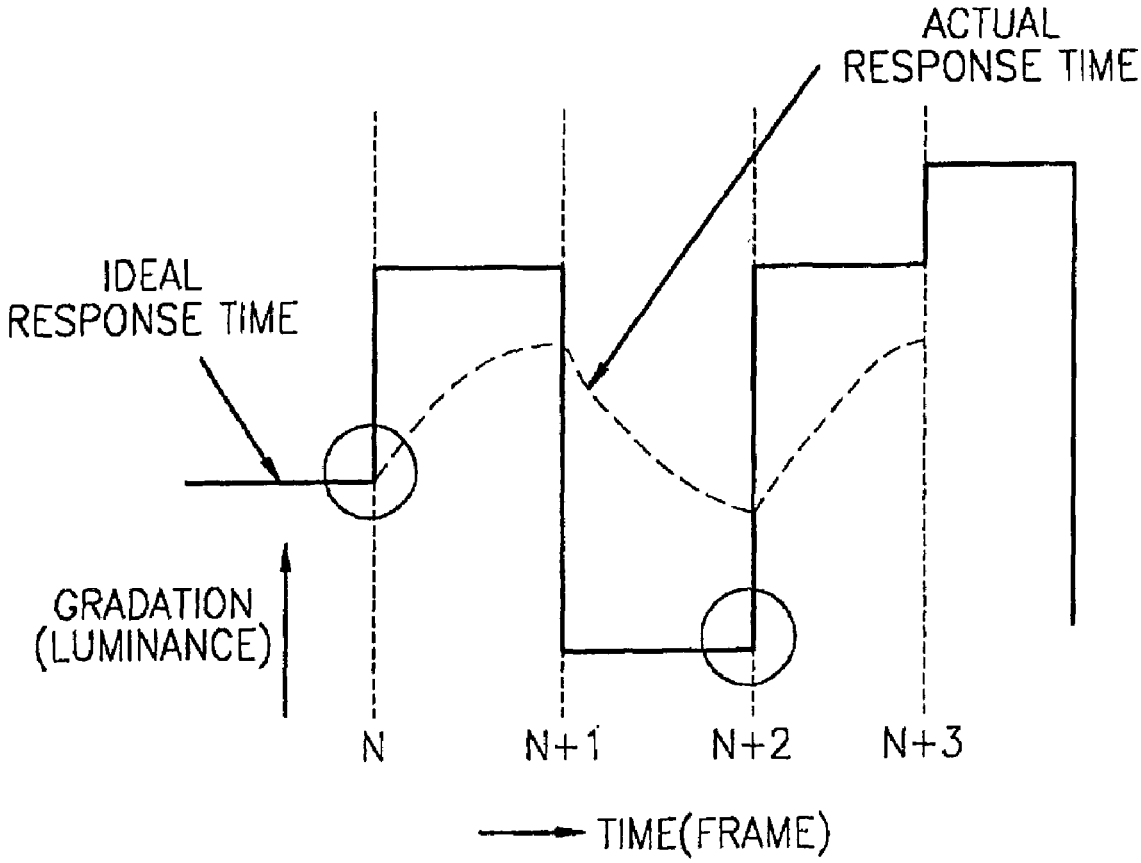
FIG. 1 (PRIOR ART)
FIG. 1 is a graph illustrating a characteristic curve of a conventional liquid crystal display (LCD)
Figure 2:
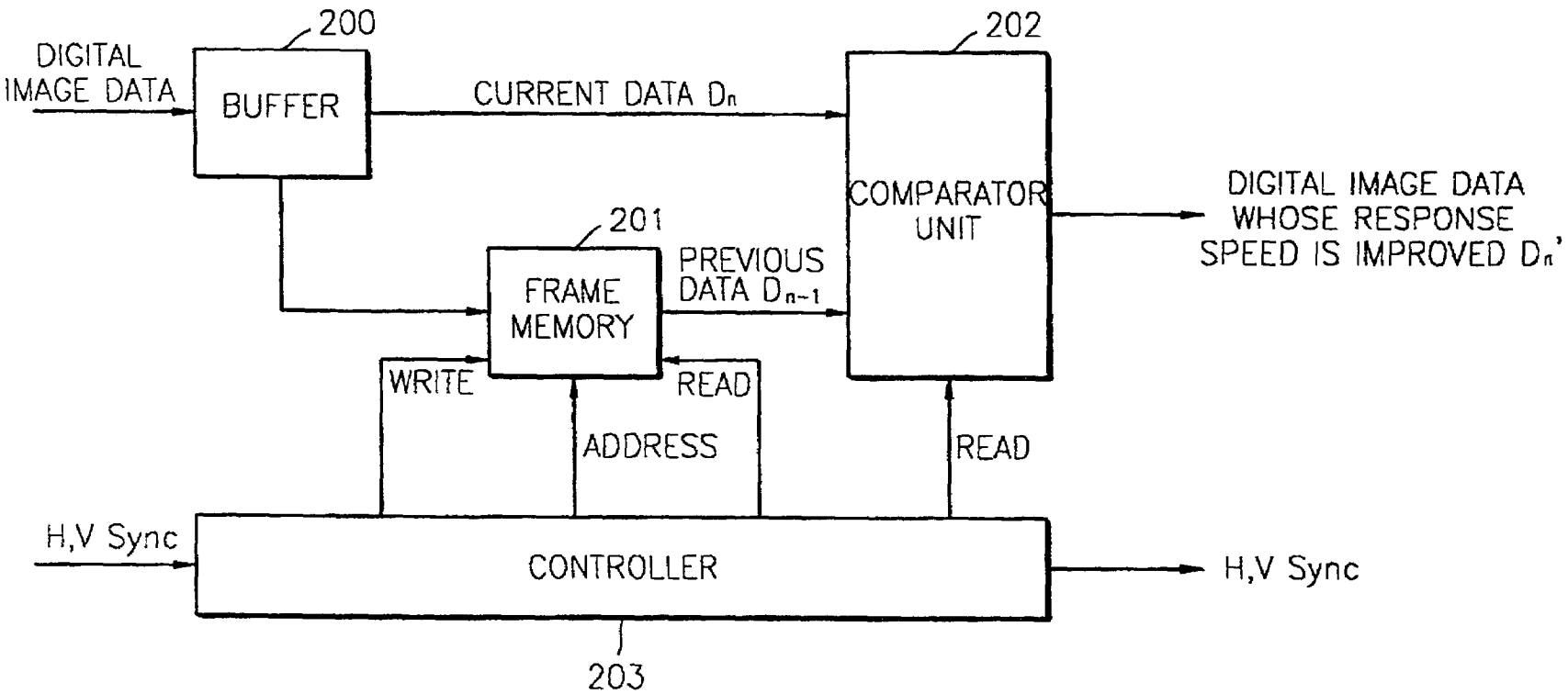
FIG. 2 (PRIOR ART)
FIG. 2 is a block diagram of a structure of a conventional apparatus to improve response speed.
Figure 3:
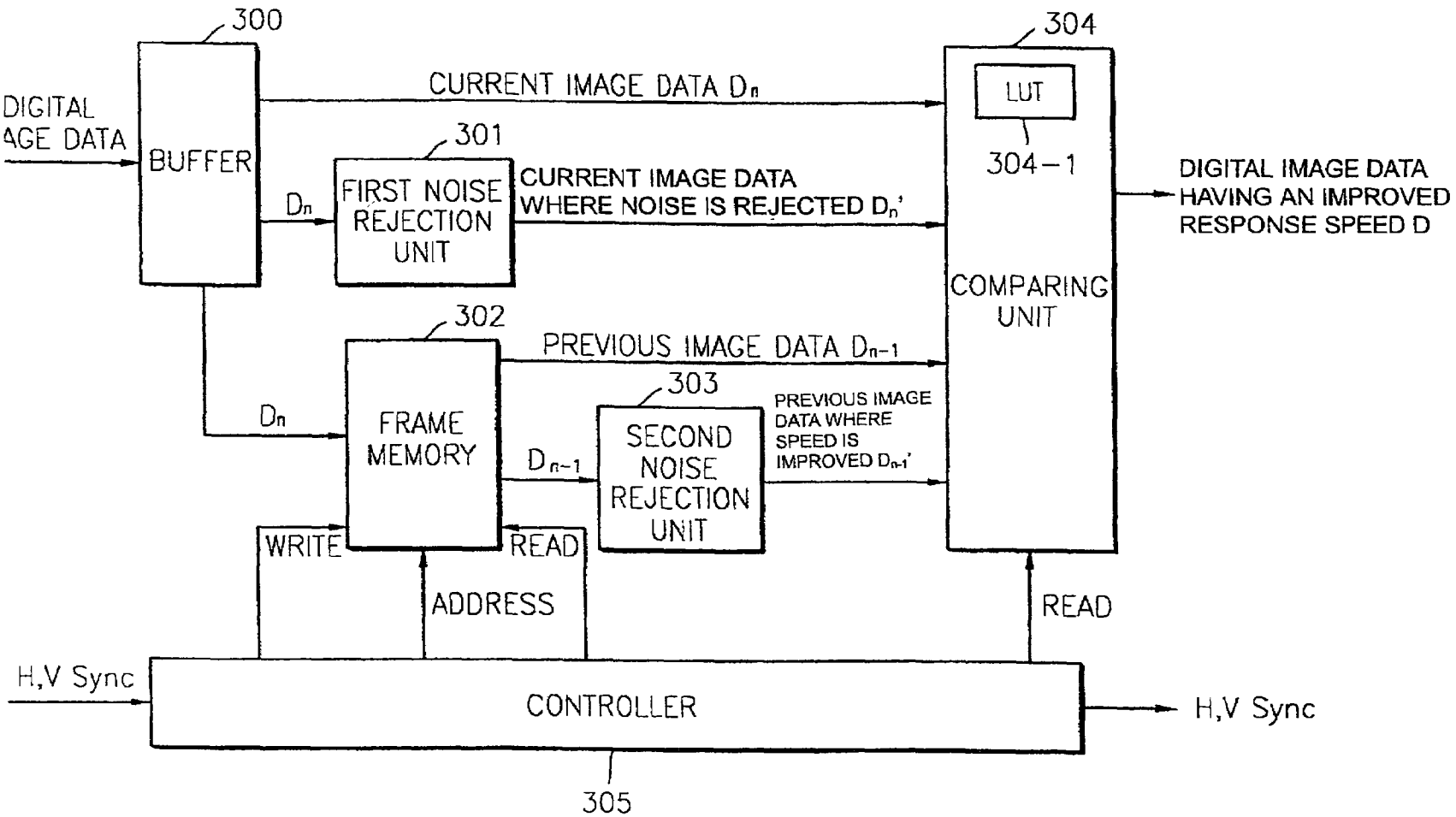
FIG. 3 is a block diagram of the structure of an apparatus to improve the response speed, according to an embodiment of the present invention.
Figure 4:
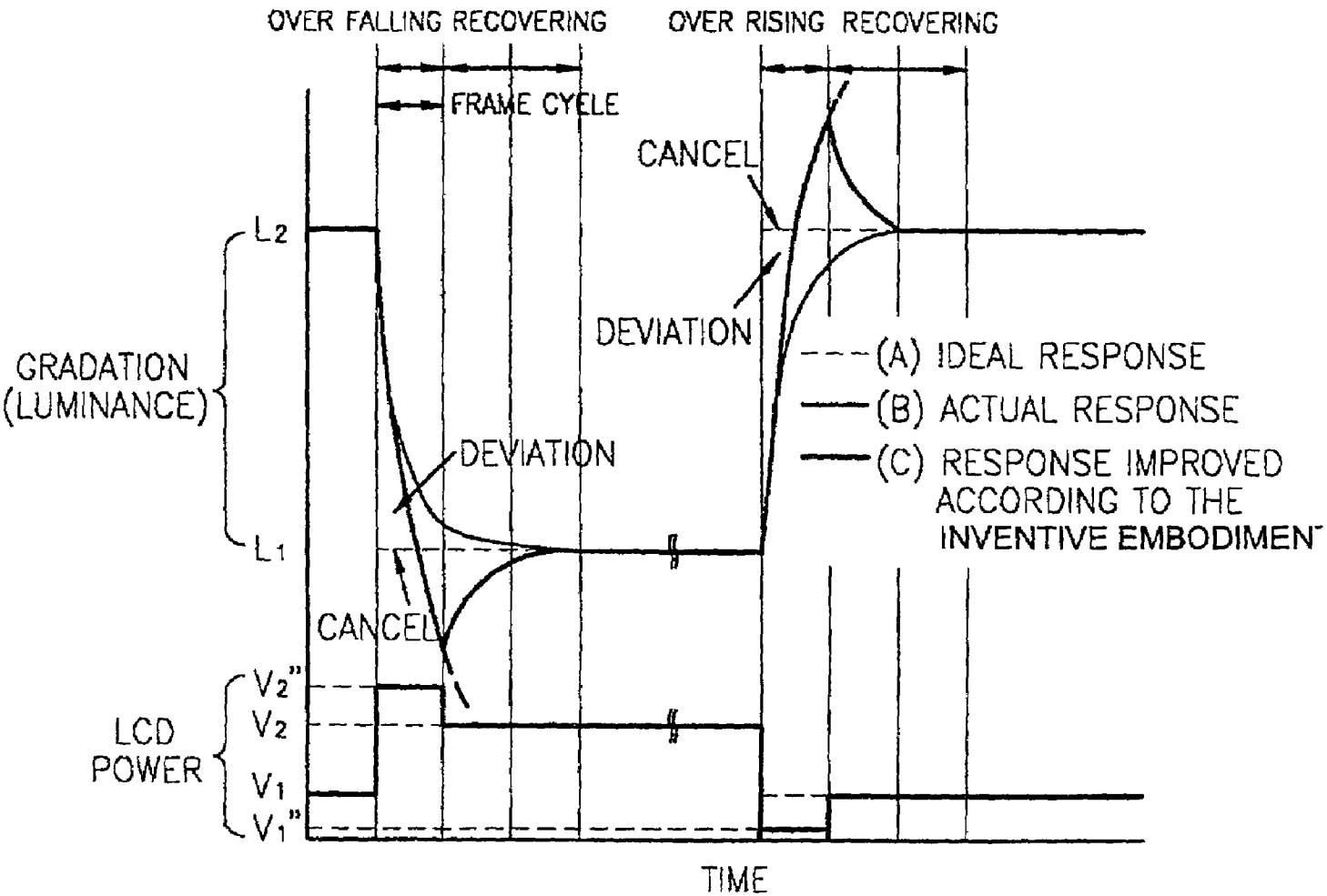
FIG. 4 is a graph illustrating a characteristic curve of the LCD having the improved response speed, according to an embodiment of the present invention.
Figure 5:
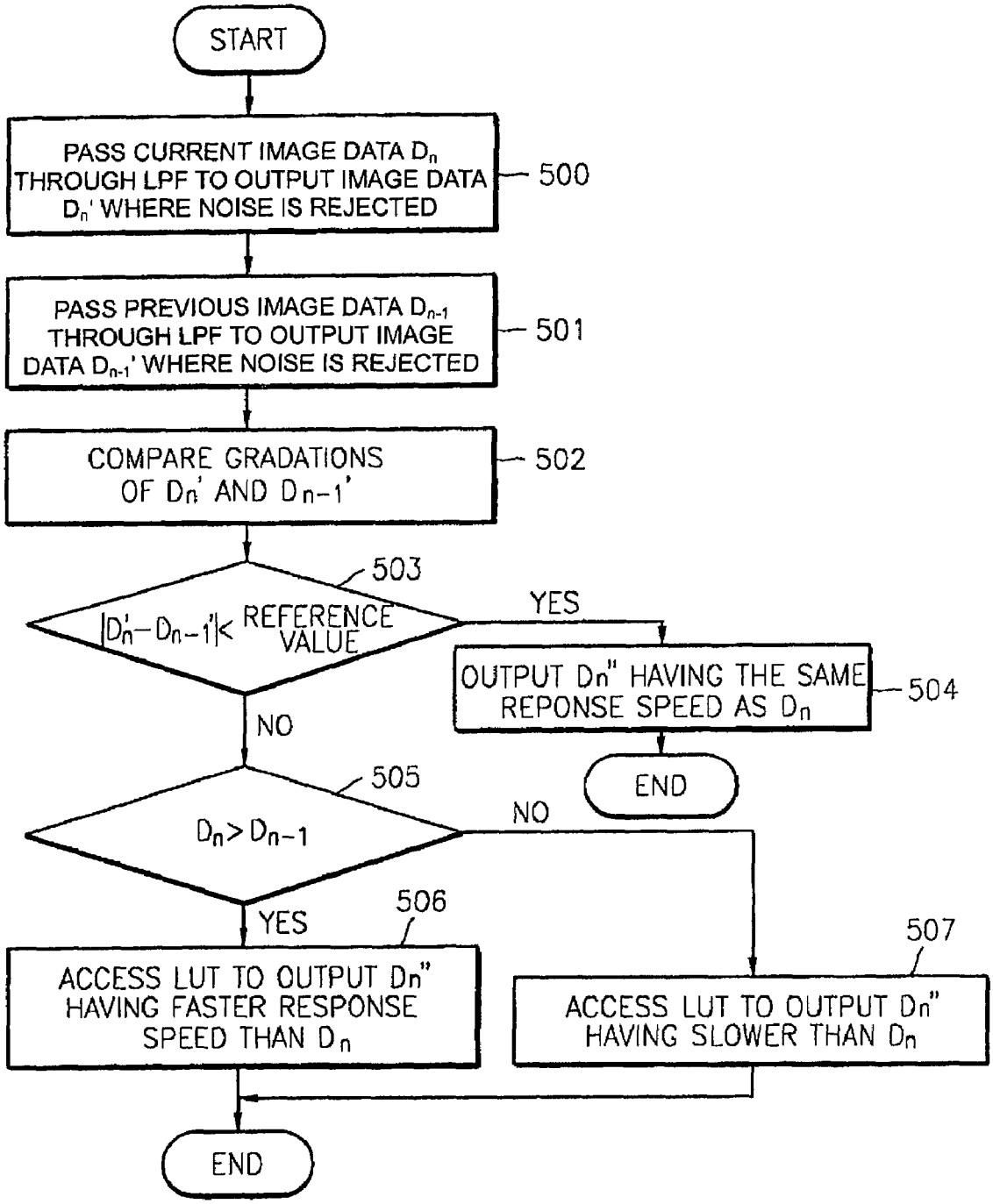
FIG. 5 is a flow chart illustrating a method to improve the response speed of the LCD, according to an embodiment of the present invention.

FIG. 3 is a block diagram of a structure of an apparatus to improve a response speed of an LCD, according to an embodiment of the present invention. The apparatus includes a buffer 300, a first noise rejection unit 301, a frame memory 302, a second noise rejection unit 303, a comparator 304, a look up table (LUT) 304-1, and a controller 305. FIG. 4 is a graph illustrating a characteristic curve of the LCD having the improved response speed. FIG. 5 is a flow chart illustrating a method to improve the response speed of the LCD according to an embodiment of the present invention. The method includes, at operation 500, outputting data $D_n'$ where noise is rejected by passing current image data $D_n$ through a low-pass filter (LPF).

At operation 501, the method outputs data $D_{n-1}'$ where the noise is rejected by passing previous image data $D_{n-1}$ through the LPF at a same pixel position of the current image data $D_n$. At operation 502, the method compares the data $D_n'$ and the data $D_{n-1}'$ where noises are rejected. At operation 503, the method checks whether a difference between gradations of the data $D_n'$ and the data $D_{n-1}'$ is smaller than a reference value, which is gradation data stored in the LUT 304-1. At operation 504, the method outputs data $D_n''$ that has the same response speed as the current data $D_n$ and, at2 operation 505, the method checks whether the gradation of the current data $D_n$ is larger than the gradation of the data $D_{n-1}$. At operation 506, the method outputs data $D_n''$ that has the response speed faster than that of the current image data $D_n$ by accessing an LUT. At operation 507, the method outputs data $D_n''$ that has the response speed slower than that of the current image data $D_n$ by accessing the LUT.

Hereinafter, the apparatus to improve the response speed, according to an embodiment of the present invention, will be described in detail with reference to FIGS. 3 and 4. Here, the buffer 300 temporarily stores an input digital image data.

The first noise rejection unit 301 includes a low-pass filter (LPF), and rejects the noise contained in the image data $D_n$ output from the buffer 300. The first noise rejection unit 301 receives the image data $D_n$ and outputs the image data $D_n'$.

The frame memory 302 stores the current image data $D_n$ output from the buffer 300 and outputs the previous image data $D_{n-1}$, which precedes the current image data $D_n$, in response to a control signal from the controller 305.

The second noise rejection unit 303 also includes an LPF, and outputs image data $D_{n-1}'$ indicative of the noise rejected from the previous image data $D_{n-1}$.

The comparator 304 receives and compares the current image data $D_n$, the current image data $D_n'$ that has the noise rejected, the previous image data $D_{n-1}$ having a same pixel position as the current image data $D_n$, and the previous image data $D_{n-1}'$ that has the noise rejected. Thereafter, the comparator 304 outputs the current image data $D_n''$ having an improved response speed. The comparator 304 includes the LUT 304-1 that holds the gradation data that changes the response speed of the current digital image data and outputs the gradation data that changes the gradation of the current image data $D_n$.

The comparator 304 compares a difference between gradations of the current image data $D_n'$ and previous image data $D_{n-1}'$ where the noises are rejected with the reference value, and outputs the image data $D_n''$ having the same response speed as the current image data $D_n$, when the difference is smaller than the reference value. Here, $D_n''$ denotes the same current image data $D_n$.

On the contrary, if the difference is larger than the reference value, the comparator 304 compares the gradation of the current image data $D_n$ and the gradation of the previous image data $D_{n-1}$, changes the response speed of the current image data $D_n$, i.e., changes the gradation, and outputs the current image data $D_n$. When the gradation of the current image data $D_n$ is larger than that of the previous image data $D_{n-1}$, the comparator 304 accesses the LUT 304-1 and outputs the image data $D_n''$ having the response speed faster than the current digital image data $D_n$. Here, $D_n''$ denotes the current image data $D_n$ having the increased gradation. When the gradation of the current image data $D_n$ is smaller than that of the previous image data $D_{n-1}$, the comparator 304 accesses the LUT 304-1 and outputs the image data $D_n''$ with the response speed slower than that of the current digital image data $D_n$. Here, $D_n''$ denotes the current image data $D_n$ with the reduced gradation.

Referring to FIG. 4, (a) illustrates an LCD ideal response, (b) illustrates an LCD actual response, and (c) illustrates the LCD response after applying the inventive embodiment. In detail, the response in (c) is obtained by comparing the gradation of the image signal where the noise is rejected with the reference value and the gradation of the image signal is improved based on the compared result. The response in (c) is approximately closer to the LCD ideal response in (a) than the LCD actual response in (b), thereby correcting image distortion.

FIG. 5 is a flow chart illustrating the method of improving the response speed. At operation 500, the current image data $D_n$ is passed through the LPF 301 to reject noise therein and is output as the $D_n'$.

At operation 501, the previous image data $D_{n-1}$ is passed through the LPF 301, the same pixel position as the current image data $D_n$, so as to cancel the noise in the previous image data $D_{n-1}$ and is output as data $D_{n-1}'$. At operation 502, the comparator 304 compares the gradation of the current image data $D_n'$ and the gradation of the previous image data $D_{n-1}'$. At operation 503, the comparator 304 checks if the difference between the gradations of the current image data $D_n'$ and previous image data $D_{n-1}'$ is smaller than the reference value.

If it is determined at operation 503 that the difference is smaller than the reference value, at operation 504, the image data $D_n''$ that has the same response speed as the current image data $D_n$ is output. Here, $D_n$ denotes the same current image data $D_n$.

If it is determined at operation 503 that the difference is larger than the reference value, at operation 505, the comparator 304 checks whether the gradation of the current image data $D_n$ is larger than that of the previous image data $D_{n-1}$.

When the difference between the gradations of the current image data $D_n'$ where the noise is rejected and the previous image data $D_{n-1}'$ where the noise is rejected is larger than the reference value and the gradation of the current image data $D_n$ is larger than the previous image data $D_{n-1}$, at operation 506, the LUT 304-1 is accessed to output image data $D_n''$ that has a larger response speed than the current image data $D_n$. Here, $D_n''$ denotes the current image data where gradation is increased.

When the gradation difference is larger than the reference value and the gradation of the current image data $D_n'$ is smaller than the gradation of the previous image data $D_{n-1}'$, at operation 507, the LUT 304-1 is accessed to output the image data $D_n''$ of which the response speed is slower than the current image data $D_n$. Here, $D_n''$ denotes the current image data $D_n$ having the reduced gradation.

As described above, according to the present invention, image distortion due to noise, which is a problem in existing methods to improve a response speed, can be solved. Further, the response speed of an LCD is improved, thereby reducing an occurrence of ghost and blurring edges to a desired level.

The various features and advantages of the invention are apparent from the detailed specification and, thus, it is intended by the appended claims to cover such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus to improve a response speed of an LCD, the apparatus comprising:

a noise rejection unit to reject noise in current digital image data and previous digital image data at a same pixel position as in the current digital image data; and a comparator to compare a difference between the current digital image data and the previous digital image data of which noises are rejected with, a reference value, to change the current digital image data based on a comparison result, and to output a result indicative thereof, wherein the comparator comprises a look up table (LUT) to store gradation data that changes a response speed of the current digital image data.

2. The apparatus of claim 1, wherein the noise rejection unit comprises:

a first low-pass filter (LPF) to reject a noise in the current digital image data; and a second LPF to reject the noise in the previous digital image data at the same pixel position as in the current digital image data.

3. An apparatus to improve a response speed of an LCD, the apparatus comprising:

a noise rejection unit to reject noise in current digital image data and previous digital image data at a same pixel position as in the current digital image data; and a comparator to compare the current digital image data and the previous digital image data of which noises are rejected within a reference value, to change the current digital image data based on a comparison result, and to output a result indicative thereof, wherein the comparator comprises a look up table (LUT) to store gradation data that changes a response speed of the current digital image data and accesses the LUT to output the current digital image data when a difference between gradations of the current digital image data and the previous digital image data, of which the noise is rejected, is smaller than the reference value.

4. An apparatus to improve a response speed of an LCD, the apparatus comprising:

a noise rejection unit to reject noise in current digital image data and previous digital image data at a same pixel position as in the current digital image data; and a comparator to compare the current digital image data and the previous digital image data of which noises are rejected within a reference value, to change the current digital image data based on a comparison result, and to output a result indicative thereof, wherein the comparator comprises a look up table (LUT) to store gradation data that changes a response speed of the current digital image data and compares the gradation of the current digital image data and the gradation of the previous digital image data, changes the current digital image data and outputs the result, when the difference between the gradations of the current digital image data and the previous digital image data of which the noise is rejected, is larger than the reference value.

5. The apparatus of claim 4, wherein the comparator accesses the LUT to increase the gradation of the current digital image data and outputs the result when the difference between the gradations of the current digital image data and the previous digital image data, of which the noise is rejected, is larger than the reference value and the gradation of the current digital image data is larger than the gradation of the previous digital image data.

6. The apparatus of claim 4, wherein the comparator accesses the LUT to decrease the gradation of the current digital image data and outputs the result when the difference between the gradation of the current digital image data and the previous digital image data, of which the noise is rejected, is larger than the reference value and the gradation of the current digital image data is smaller than the gradation of the previous digital image data.

7. An apparatus to improve a response speed of an LCD, comprising:

a buffer receiving digital image data and outputting first current image data;

a first noise rejection unit rejecting noise in the first current image data and outputting second current image data where noise is rejected;

a frame memory storing the first current image data and outputting first previous image data, which precedes the first current image data;

a second noise rejection unit outputting second previous image data indicative of noise rejected from the first previous image data;

a comparator comparing gradations of the first current image data, the second current image data, the first previous image data, and the second previous image data to output the digital image data having the improved response speed.

8. The apparatus of claim 7, wherein the comparator comprises a look up table (LUT) holding gradation data to change a response speed.

9. The apparatus of claim 7, wherein the first previous image data has a same pixel position as the first current image data.

10. The apparatus of claim 7, wherein the comparator compares a difference between the gradations of the second current image data and the second previous image data and, when the difference is smaller than a reference value, the comparator outputs the digital image data having a same response speed as the first current image data.

11. The apparatus of claim 7, wherein the comparator compares a difference between the gradations of the second current image data and the second previous image data and, when the difference is larger than a reference value, the comparator changes the response speed of the first current image data and outputs the digital image data indicative thereof.

12. The apparatus of claim 7, wherein when the gradation of the first current image data is larger than the gradation of the first previous image data, the comparator accesses a look up table (LUT) and outputs the digital image data having the response speed faster than the first current digital image data.

13. The apparatus of claim 7, wherein when the gradation of the first current image data is smaller than the gradation of the first previous image data, the comparator accesses a look up table (LUT) and outputs the digital image data having a response speed slower than that of the first current digital image data.

14. The apparatus of claim 7, wherein the comparator compares a difference between the gradations of the second current image data and the second previous image data and the comparator performs one of the digital image data having a same response speed as the first current image data when the difference is smaller than a reference value, changes the response speed of the first current image data and outputs the digital image data indicative thereof when the difference is larger than a reference value, and accesses a look up table (LUT) and outputs the digital image data having the response speed faster than the first current digital image data when the gradation of the first current image data is larger than the gradation of the first previous image data.

15. A method of improving response speed of an LCD, the method comprising:

rejecting noise in a previous digital image data at a same pixel position as a current digital image data;

comparing a difference between gradations of the current digital image data and the previous digital image data with a reference value and outputting a result indicative thereof; and accessing an LUT storing gradation data that changes a response speed, to change the current digital image data based on the result.

16. A method of improving response speed of an LCD, the method comprising:

rejecting noise in a previous digital image data at a same pixel position as a current digital image data;

comparing a difference between gradations of the current digital image data and the previous digital image data with a reference value and outputting a result indicative thereof; and accessing an LUT storing gradation data that changes a response speed, to change the current digital image data based on the result, wherein when accessing the LUT, the LUT is accessed to output the current digital image data when the difference between the gradations of the current digital image data and the previous digital image data, of which the noise is rejected, is smaller than the reference value.

17. The method of claim 16, wherein when accessing the LUT, the gradation of the current digital image data is compared with the gradation of the previous digital image data, the gradation of the current digital image data is changed based on the comparison result, and the result is output when the difference between the gradations of the current digital image data and the previous digital image data, of which the noise is rejected, is larger than the reference value.

18. The method of claim 17, wherein the LUT is accessed to increase the gradation of the current digital image data and output the result, when the difference between the gradations of the current digital image data and the previous digital image data, of which the noise is rejected, is larger than the reference value and the gradation of the current digital image data is larger than the gradation of the previous digital image data.

19. The method of claim 17, wherein the LUT is accessed to decrease the gradation of the current digital image data and output the result, when the difference between the gradations of the current digital image data and the previous digital image data, of which the noise is rejected, is larger than the reference value and the gradation of the current digital image data is smaller than the gradation of the previous digital image data.

20. A method to improve a response speed of an LCD, comprising:

outputting first current image data based on digital image data;

rejecting noise in the first current image data and outputting second current image data indicative thereof;

outputting first previous image data preceding the first current image data;

rejecting noise in the first previous image data and outputting second previous image data indicative thereof;

comparing a gradation of the second current image data and a gradation of the second previous image data; and outputting the digital image data having a same response speed as the first current image data when a difference between the gradations of the second current image data and the second previous image data is smaller than a reference value.

21. A method to improve a response speed of an LCD, comprising:

outputting first current image data based on digital image data;

rejecting noise in the first current image data and outputting second current image data indicative thereof;

outputting first previous image data preceding the first current image data;

rejecting noise in the first previous image data and outputting second previous image data indicative thereof;

comparing a gradation of the second current image data and a gradation of the second previous image data; and determining whether the gradation of the first current image data is larger than the gradation of the first previous image data when a difference between the gradations of the second current image data and the second previous image data is larger than a reference value.

22. The method of claim 21, further comprising: outputting the digital image data having the response speed faster than the first current digital image data when the gradation of the first current image data is larger than the gradation of the first previous image data.

23. The method of claim 21, further comprising:

outputting the digital image data having a response speed slower than that of the first current digital image data when the gradation of the first current image data is smaller than the gradation of the first previous image data.

24. An apparatus to improve a response speed of an LCD, the apparatus comprising:

a comparing unit, comprising a LUT (look up table) to store gradation data, to compare a difference between gradations of current digital image data and previous digital image data with a reference value to change the gradation of the current digital image data according to the result of the comparison, and to output a changed gradation, wherein when the difference between the gradations of the current digital image data and the previous digital image data is less than the reference value, the current digital image data is output.

25. The apparatus according to claim 24, further comprising:

a first LPF (low-pass filter) to input the current digital image data; and a second LPF to input the previous digital image data;

wherein the difference is a gradation difference between the current digital image data output from the first LPF and the previous digital image data out put from the second LPF.

26. The apparatus according to claim 24, wherein when the difference between the gradations of the current digital image data and the previous digital image data is greater than the reference value, the LUT is accessed and the gradation of the current digital data is converted and output.

27. A method of improving a response speed of an LCD, the method comprising:

comparing a difference between gradations of the current digital image data and the previous digital image data with a reference value; and accessing an LUT (look up table) storing gradation data that changes a response speed of digital image data based ont he result of comparison and changing the gradation of the current digital image data to be output.

28. The method according to claim 27, wherein when the difference between the gradations of the current digital image data and the previous digital image data is less than the reference value, accessing the LUT and outputting the current digital data.

29. The method according to claim 27, wherein when the difference between the gradations of the current digital image data and the previous digital image data is greater than the reference value, accessing the LUT, and converting and outputting the gradation of the current digital image data.

30. The method acccording to claim 29, wherein when the gradation of the current digital image data is greater than the gradation of the previous digital image data, accessing the LUT and increasing the gradation of the current digital image data and outputting the current digital image data.

31. The method according to claim 29, wherein when the gradation of the current digital image data is less than the gradation of the previous digital image data, accessing the LUT and decreasing the gradation of the current digital image data and outputting the current digital image data.

32. An apparatus to improve a response speed of an LCD, the apparatus comprising:

a comparing unit, comprising an LUT (look up table) to store gradation data, to compare gradations of the current digital image data and previous digital image data with a reference value to change the gradation of the current digital image data according to the result of the comparison, and to output a changed gradation, wherein when a difference between the gradations of the current digital image data and the previous digital image data is less than the reference value, the current digital image data is output.

33. The apparatus according to claim 32, wherein when a differencce between the gradations of the current digital image data and the previous digital image data is greater than the reference value, the LUT is accessed and the gradation of the current digital image data is converted and output.

34. The apparatus according to claim 33, wherein when the gradation of the current digital image data is greater than the gradation of the previous digital image data, the LUT is accessed and the gradation of the current digital image data is increased and output.

35. The apparatus according to claim 33, wherein when the gradation of the current digital image data is less than the gradation of the previous digital image data, the LUT is accessed and the gradation of the current digital image data is decreased and output.

36. An apparatus to improve a response speed of an LCD, the apparatus comprising:

a filter to reject noise in current digital image data and previous digital image data;

a comparing unit, comprising a LUT (look up table) to store gradation data, the compare the current digital image data and the previous digital image data of which noises are rejected, with a reference value to change the current digital image data based on the comparison, and to output a changed gradation, wherein when a difference between the gradations of the current digital image data and the previous digital image data is less than the reference value, the current digital image data is output.

37. The apparatus according to claim 36, wherein when a difference between the gradations of the current digital image data and the previous digital image data is greater than the reference value, the LUT is accessed and the gradation of the current digital data is converted and output.

38. An apparatus to improve a response speed of an LCD, comprising:

means for rejecting noise in current digital image data and previous image data;

means for comparing a difference between a current digital image data and the previous digital image data of which noises are rejected with a reference value, to change the current digital image data based on the comparison, and to output a result indicative thereof; and means for storing and accessing gradation data that changes a response speed of the current digital image data, wherein when the difference between the gradations of the current digital image data and the previous digital image data is less than the reference value, the current digital image data is output.

39. The apparatus according to claim 38, wherein when the difference between the gradations of the current digital image data and the previous digital image data is greater than the reference value, accessing the stored gradation data and the gradation of the current digital image data is converted and output.

* * * * *

UNITED STATES PATENT AND TRADEMARK OFFICE

CERTIFICATE OF CORRECTION

PATENT NO. : 7,221,347 B2
APPLICATION NO. : 10/299764
DATED : May 22, 2007
INVENTOR(S) : Sang-hak Lee et al.

It is certified that error appears in the above-identified patent and that said Letters Patent is hereby corrected as shown below:

Column 10, Line 56, change “out put” to --output--.

Column 11, Line 3, change “ont he” to --on the--.

Column 11, Line 16, change “acccording” to --according--.

Column 11, Line 38, change “differencce” to --difference--.

Column 12, Line 10, after “data,” change “the” to --to--.

Signed and Sealed this

Eighteenth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 7,221,347 B2
APPLICATION NO. : 10/299764
DATED : May 22, 2007
INVENTOR(S) : Sang-hak Lee et al.

It is certified that error appears in the above-identified patent and that said Letters Patent is hereby corrected as shown below:

Column 10, Line 38, change “LUT (look up table)” to --look up table (LUT)--.
Column 10, Line 43, change “the” to --a--.
Column 10, Line 65, delete “the”.
Column 10, Line 66, delete “the”.
Column 11, Line 1, change “an LUT (look up table)” to --a look up table (LUT)--.
Column 11, Line 3, change “ont he” to --on a--.
Column 11, Line 3, after “of” insert --the--.
Column 11, Line 10, after “wherein” insert --the method futher comprises--.
Column 11, Line 14, change “the current” to --the converted current--.

Signed and Sealed this
First Day of March, 2011

David J. Kappos

David J. Kappos
*Director of the United States Patent and Trademark Office*